US006981397B2

(12) United States Patent
Meyer

(10) Patent No.: US 6,981,397 B2
(45) Date of Patent: Jan. 3, 2006

(54) ROLL FORMING MACHINE WITH IMPROVED ADJUSTABILITY AND PROFILE CHANGING CAPABILITY

(75) Inventor: Bruce E. Meyer, Arvada, CO (US)

(73) Assignee: Englert, Inc., Perth Amboy, NJ (US)

( * ) Notice: Subject to any disclaimer, the term of this patent is extended or adjusted under 35 U.S.C. 154(b) by 65 days.

(21) Appl. No.: 10/805,622

(22) Filed: Mar. 15, 2004

(65) Prior Publication Data

US 2005/0199030 A1 Sep. 15, 2005

(51) Int. Cl.
*B21D 5/08* (2006.01)

(52) U.S. Cl. ..... 72/181

(58) Field of Classification Search ..... 72/181, 72/179, 182, 226
See application file for complete search history.

(56) References Cited

U.S. PATENT DOCUMENTS 3,529,461 A * 9/1970 Knudson ..... 72/181
4,716,754 A * 1/1988 Youngs ..... 72/178
4,899,566 A * 2/1990 Knudson ..... 72/129
4,947,671 A * 8/1990 Lindstrom ..... 72/181
5,425,259 A 6/1995 Coben et al. ..... 72/181

* cited by examiner

*Primary Examiner*—Daniel C. Crane
(74) *Attorney, Agent, or Firm*—David L. Davis

(57) ABSTRACT

A roll forming machine wherein a single operator can quickly replace roll forming stations to change the desired lateral profile and wherein adjustments to the lateral positions of the roll forming stations can be quickly effected. This is accomplished by mounting the roll forming elements on short tooling rail sections which in turn are mounted on longer mounting rails which are used as platforms whereby all the adjustments are preset so that all setup work is performed prior to installing the tooling rails. Because the tooling rail sections are shorter, they may be inserted in, and removed from, the machine by a single operator without requiring the partial disassembly, and subsequent reassembly, of the entry and shear assemblies.

12 Claims, 9 Drawing Sheets

ROLL FORMING MACHINE WITH IMPROVED ADJUSTABILITY AND PROFILE CHANGING CAPABILITY

BACKGROUND OF THE INVENTION

This invention relates to roll forming machines which form an indeterminate length panel of a desired lateral profile from a supply strip of sheet metal and, more particularly, to such a machine wherein a single operator can quickly replace roll forming stations to change the desired lateral profile and wherein adjustments to the lateral positions of the roll forming stations can be quickly effected.

Roll forming machines are well known in the construction industry. Such a machine is typically mounted on the bed of a pickup truck, van, trailer, or the like, so that it can be transported to, and used at, the site where siding panels, roofing panels and rain gutters are to be installed. Typically, such a machine comprises a series of spaced forming stations, each having upper and lower shaping rollers between which a sheet metal strip is passed, so as to impart a desired shape, or lateral profile, to the sheet metal strip, which is uniform along the length of the sheet metal strip after it exits the machine. The strip is cut to its desired length as it exits the roll forming machine. Different combinations of rollers provide different lateral profiles to the strip. Conventionally, each machine is designed to provide a single predetermined lateral profile to the sheet metal strip.

U.S. Pat. No. 5,425,259 discloses a roll forming machine where the forming stations are mounted on a set of rail structures which can be interchanged with a different set of rail structures to form a different lateral profile. This allows the operator to change lateral profiles without having to remove and replace each individual forming station. According to this patent, the rail structures on the right side of the machine are mounted directly to the machine frame by the use of mounting blocks that stay with the rail structures when changed for a different set of forming stations. The two rail structures on the left side of the machine are mounted directly to threaded adjustment traveler bar blocks and have to be realigned relative to the machine frame every time a set of rail structures is mounted into the machine. This realignment requires at least two adjustments. First, the rail structures on the left side have to be adjusted to ensure that they are parallel to the rail structures on the right side of the machine. Second, the first rail structure on the left side has to be adjusted to have a given offset relative to the second rail structure on the left side of the machine. This is accomplished by turning the nuts on the threaded adjustment traveler bar blocks on the first rail structure so that the first rail structure is moved left or right until the proper offset is achieved. While adjusting this offset, the first rail structure on the left side has to be kept parallel with the rail structures on the right side of the machine.

The aforedescribed arrangement suffers from a number of disadvantages. For example, it requires two people and an average of three to four hours to replace the rail structures in order to change the lateral profile produced by the machine. There are three major reasons for this disadvantage. The first reason is that three of the four rail structures are long and heavy, requiring two people to remove and insert the rail structures from and into the machine. The second reason is that the shear and entry assemblies of the machine need to be partially disassembled and then reassembled to allow the long rail structures to be removed from and inserted into the machine. The third reason is that the rail structures must be mounted and realigned to the machine before being able to form the next lateral profile.

It would therefore be desirable to have a roll forming machine wherein the lateral profile can be easily and quickly changed by a single person.

SUMMARY OF THE INVENTION

According to this invention, there is provided a roll forming machine of the type which forms an indeterminate length panel of a desired lateral profile from a uniform width supply strip of sheet metal having a pair of parallel straight edges, the roll forming machine driving the supply strip along a predetermined path of travel through a plurality of roll forming stations. The inventive roll forming machine comprises a rigid framework including a pair of rigid parallel side frames interconnected one to the other by a plurality of rigid parallel upper and lower transverse members to form a rigid cage having an interior and a width between the side frames. A plurality of mounting blocks are each supported on a respective one of the lower transverse members adjacent a first one of the pair of side frames. Each of the mounting blocks has an upper horizontal surface and a plurality of spaced mounting holes extending into each mounting block from its upper surface. The plurality of mounting holes for each of the mounting blocks extend along a respective line orthogonal to the pair of side frames and have identical spacing on all of the plurality of mounting blocks. The upper horizontal surfaces of all of the plurality of mounting blocks lie along a single horizontal plane. A first mounting rail is secured to at least two of the plurality of mounting blocks by at least two mounting threaded members each extending through a respective opening in the first mounting rail and into a respective mounting hole in a respective one of the at least two mounting blocks. Each of the respective mounting holes occupies the same relative position in its respective mounting block so that the mounting rail is automatically parallel to the side frames of the machine. A first tooling rail is secured to the first mounting rail. At least one set of roll forming elements defining a roll forming station is secured to the first tooling rail. The first tooling rail with the at least one set of roll forming elements secured thereto is dimensioned so that it can be manipulated into and out of the cage vertically between an adjacent pair of upper transverse members. Thus, the removable sections are small enough to be handled by one person and, since they are removed vertically, the entry and shear assemblies of the machine remain intact during a tooling change.

Also according to this invention, there is provided a roll forming machine of the type which forms an indeterminate length panel of a desired lateral profile from a uniform width supply strip of sheet metal having a pair of parallel straight edges, the roll forming machine driving the supply strip along a predetermined path of travel through a plurality of roll forming stations. The inventive roll forming machine comprises a rigid framework including a pair of rigid parallel side frames interconnected one to the other by a plurality of rigid parallel upper and lower transverse members to form a rigid cage having an interior and a width between the side frames. A first plurality of threaded shafts extends into the cage from a first one of the pair of side frames orthogonal to the pair of side frames and a first plurality of traveler bar blocks are each threadedly secured to a respective one of the first plurality of threaded shafts for movement therealong. A first mounting rail is secured to at least two of the first plurality of traveler bar blocks and a first tooling rail is secured to the first mounting rail. At least one set of roll forming elements defining a roll forming station is secured to the first tooling rail. The first tooling rail with the at least one set of roll forming elements secured thereto is dimensioned so that it can be manipulated into and out of the cage vertically between an adjacent pair of upper transverse members. Thus, the removable sections are small enough to be handled by one person and, since they are removed vertically, the entry and shear assemblies of the machine remain intact during a tooling change.

In accordance with an aspect of this invention, there is provided an adjuster outside the cage which is coupled to the threaded shafts for controllably rotating the threaded shafts so that the traveler bar blocks, along with the mounting rails secured thereto, are movable toward and away from the first one of the pair of side frames.

In accordance with a further aspect of this invention, the threaded shafts are divided into two groups and the adjuster includes a clutch coupled between the two groups of threaded shafts. Each group of threaded shafts is associated with a respective mounting rail. The clutch is selectively engageable and disengageable so that one of the mounting rails can be moved independently to provide an offset between the two mounting rails.

BRIEF DESCRIPTION OF THE DRAWINGS

The foregoing will be more readily apparent from reading the following description in conjunction with the drawings in which like elements in different figures thereof are identified by the same reference numeral and wherein.

DETAILED DESCRIPTION

Figure 1:
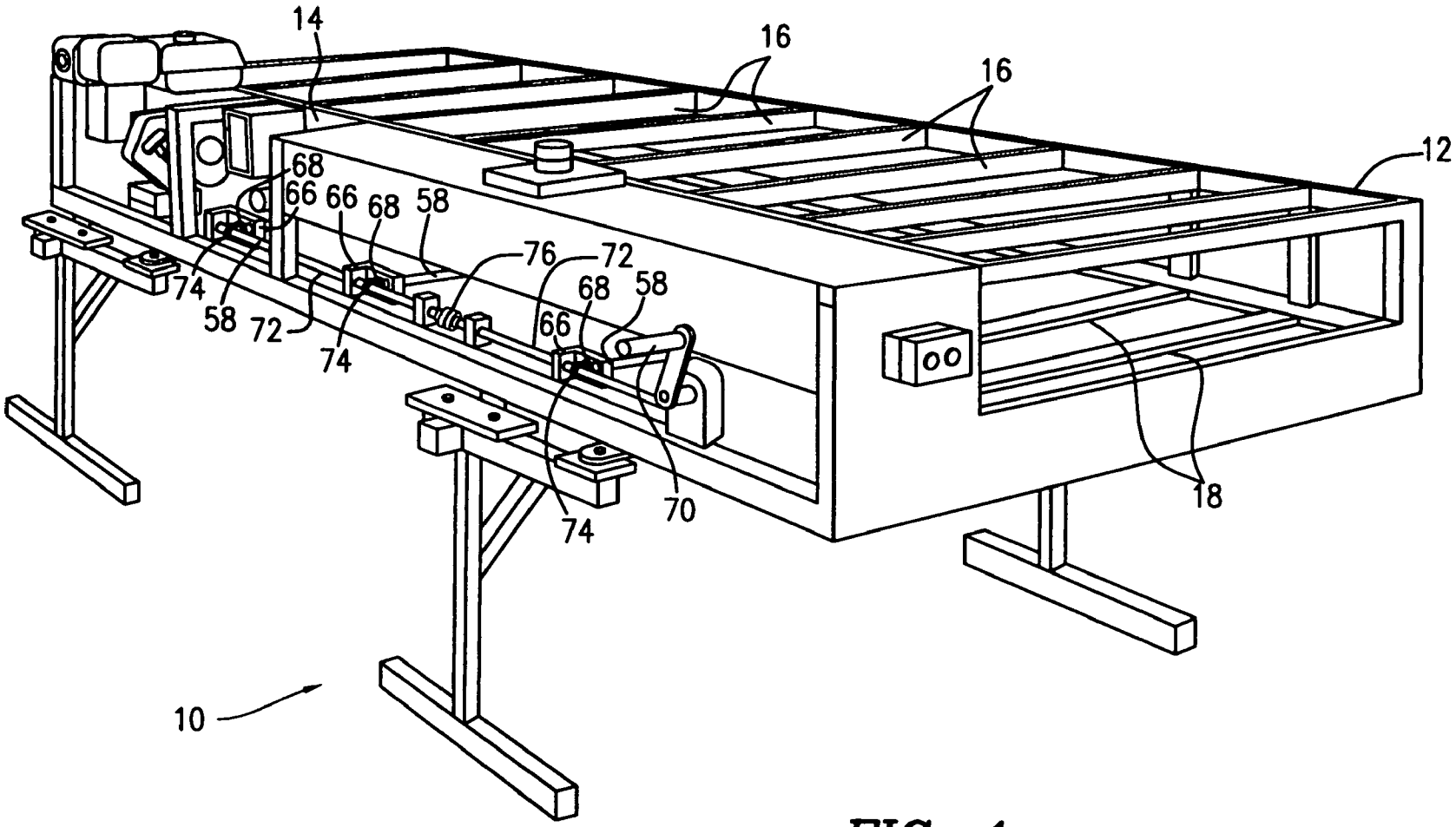
FIG. 1 is a perspective view of an embodiment of the inventive roll forming machine showing the rigid cage structure.
Figure 10A:
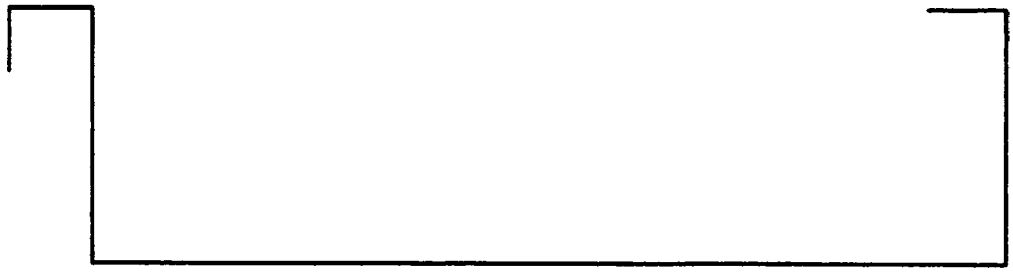
FIGS. 10*a* and 10*b* illustrate sample lateral profiles of roofing panels which can be formed by the inventive roll forming machine.
Figure 10B:
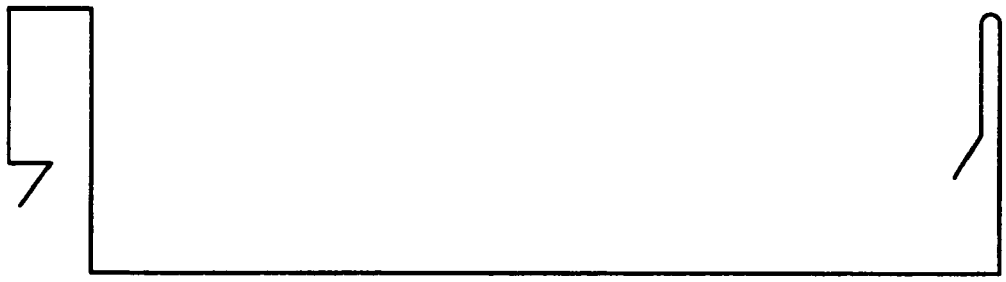

Referring now to the drawings, FIG. 1 shows a roll forming machine, designated generally by the reference numeral 10, which incorporates structure according to the principles of this invention. Roll forming machines, per se, are well known in the art and therefore will not be described in detail herein, except for those portions of the machine 10 which particularly relate to the present inventive improvements. The machine 10 is designed to form an indeterminate length panel of a desired lateral profile from a uniform width supply strip of sheet metal (not shown) having a pair of parallel straight edges. As is known in the art, the machine 10 drives the supply strip along a predetermined path of travel through a plurality of roll forming stations. For purposes of illustration, the machine 10 is designed to form roofing panels. FIGS. 10*a* and 10*b* show illustrative lateral profiles of roofing panels which can be formed by the machine 10, depending upon which set of tooling is installed in the machine 10.

As shown, the machine 10 has a rigid framework including a pair of rigid parallel side frames 12,14 interconnected by a plurality of rigid upper and lower transverse members 16,18, respectively, to form a rigid cage having an interior and a width between the side frames 12,14. For future discussion purposes, the side of the machine 10 which is adjacent the side frame 12 will be referred to as the "right" side and the side of the machine 10 which is adjacent the side frame 14 will be referred to as the "left" side.

On the lower transverse members 18 along the right side of the machine 10 are supported a plurality of mounting blocks 20 which are each bolted to a respective block 22 which is secured, as by welding, to a respective lower transverse member 18. The pair of bolts 24 which secure a mounting block 20 to a respective block 22 extend through respective elongated slots 26 in the mounting block 20 and into internally threaded bores 28 in the block 22 so that the position of the mounting block 20 is adjustable. Such adjustability is effected by means of pusher set screws 30 to slide the mounting block 20 back and forth along a line orthogonal to the side frames 12,14. Each of the mounting blocks 20 has an upper horizontal surface 32 and a plurality of internally threaded mounting holes 34 extending into the mounting block 20 from the upper horizontal surface 32. The mounting holes 34 extend along a line orthogonal to the side frames 12,14 and are preferably equally spaced, illustratively on one-half (½) inch centers, along that line. The spacing of the mounting holes 34 is identical on all of the mounting blocks 20 and the upper horizontal surfaces 32 of all the mounting blocks 20 lie along a single horizontal plane.

According to this invention, each of a first set of mounting rails 36 is secured to at least two of the mounting blocks 20. Illustratively, there are two mounting rails 36 along the right side of the machine 10. Each mounting rail 36 is a flat stiff bar of sheet metal formed with two sets of mounting holes. The first set of mounting holes 38 are countersunk throughbores for securing the mounting rails 36 to the mounting blocks 20 by means of threaded members, such as flat head screws, 40. The mounting holes 38 are spaced the same as the spacing between the mounting blocks 20 and lie along a line substantially centered along each mounting rail 36. The second set of mounting holes 42 are internally threaded bores equally spaced (illustratively on eight inch centers) along the same central line and are for securing the tooling rails to the mounting rails 36, as will be described in full detail hereinafter. Each different lateral profile formed by a different set of tooling requires that the mounting rails 36 be secured to the mounting blocks 20 in specific ones of the mounting holes 34, in accordance with a mounting chart set forth in the operator's manual provided with the machine 10. The mounting rails are installed and set for a particular lateral profile without the presence of any tooling, resulting in an easier setup.

Figure 2:
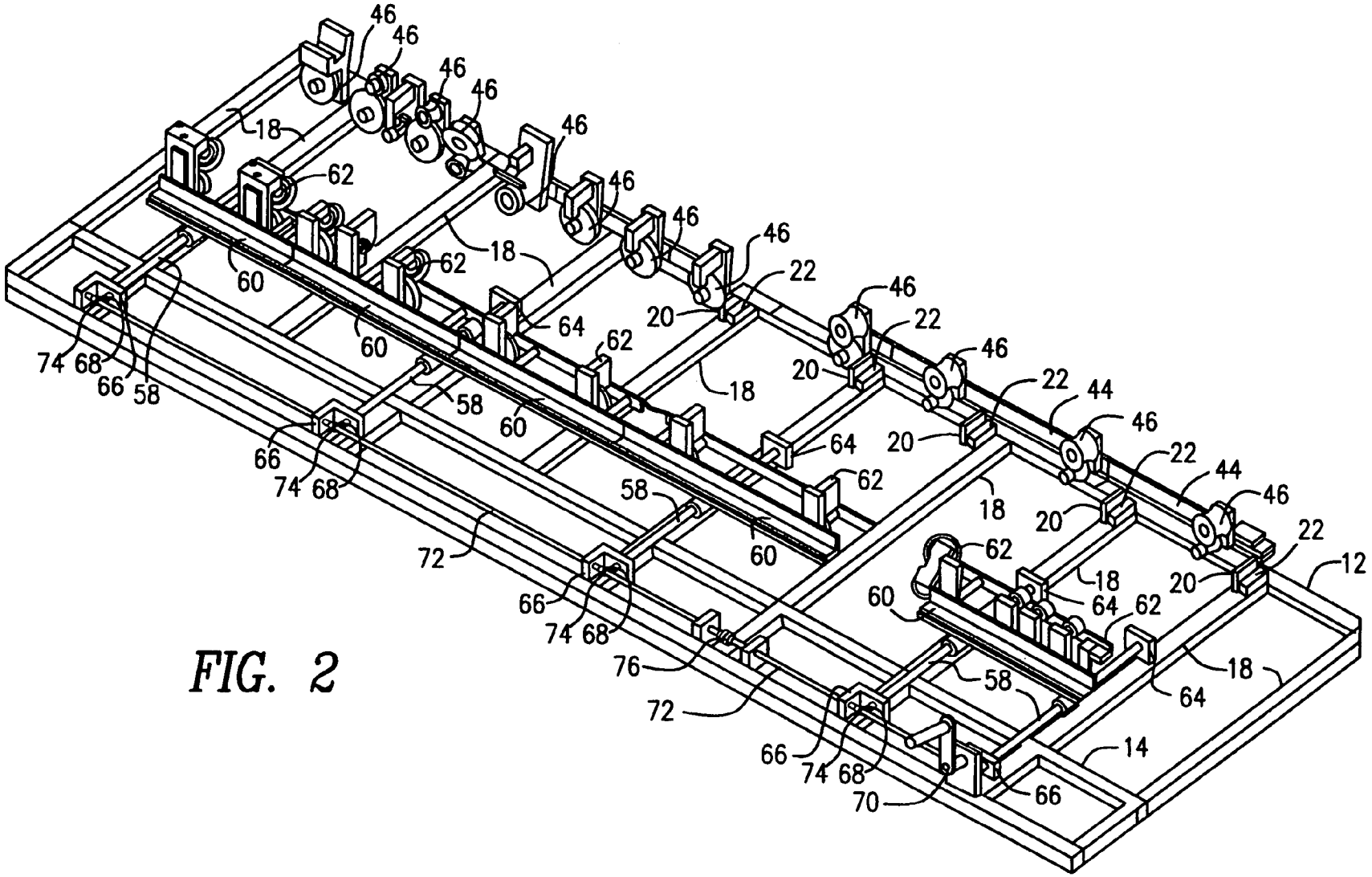
FIG. 2 is a top perspective view of the machine shown in FIG. 1 without the upper transverse frame members and drive mechanism.
Figure 3:
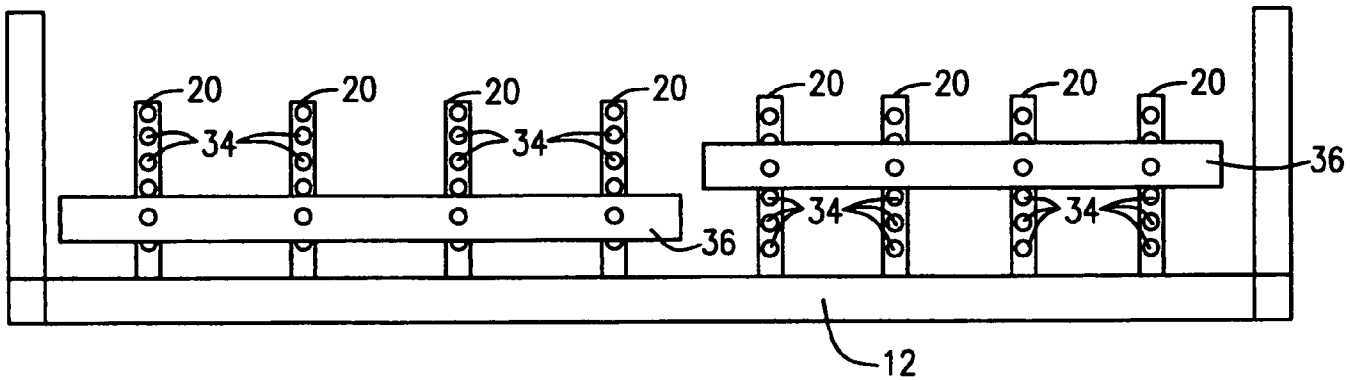
FIG. 3 is a schematic top plan view of the inventive machine showing the right side rail structures.
Figure 4:
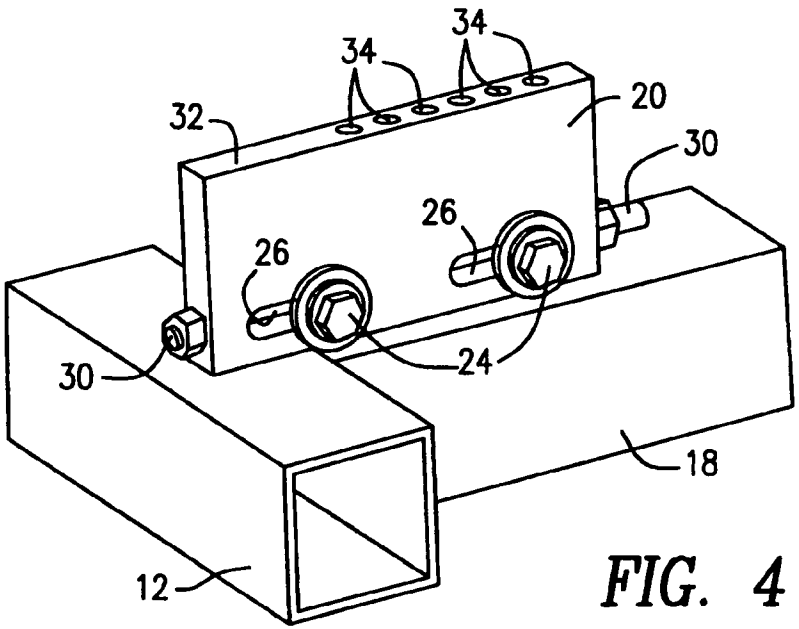
FIG. 4 is a perspective view of a mounting block used on the right side of the inventive machine.
Figure 5:
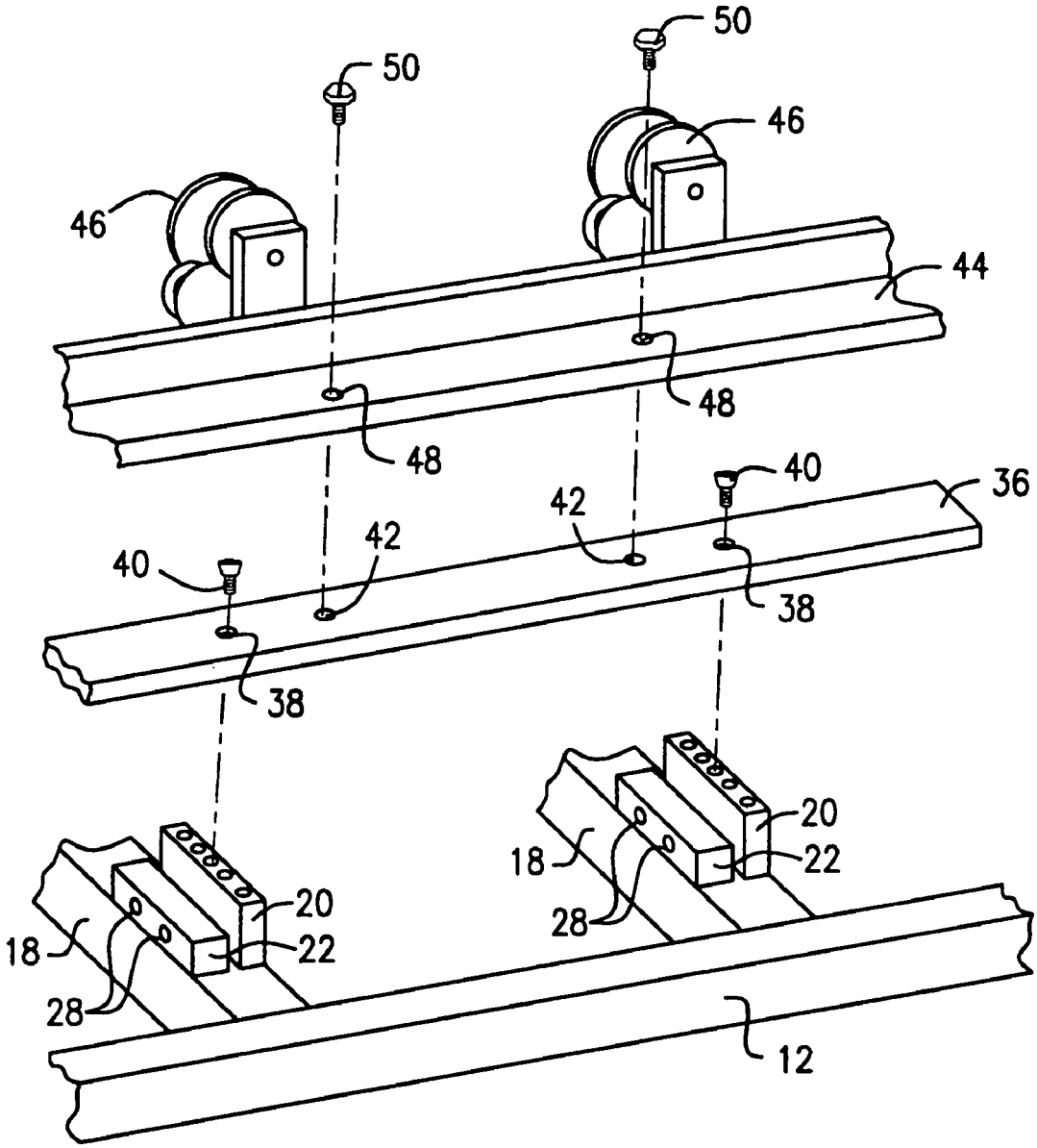
FIG. 5 is an exploded perspective view showing a tooling rail, a mounting rail and a pair of mounting blocks, illustrating how they are connected together and to lower transverse members of the framework of the inventive machine.

The mounting rails 36 are used for supporting the roll forming tooling. According to this invention, short sections of tooling rail 44 are provided. Each tooling rail 44 is an angle bracket. At least one set of roll forming elements (or tooling) 46 defining a roll forming station is secured to each tooling rail 44. Since the mounting holes 42 on the mounting rails 36 are spaced on eight inch centers and each tooling rail 44 must be secured to at least two of the mounting holes 42, each tooling rail section 44 is chosen to be less than sixteen inches in length, but longer than about nine inches. This allows a tooling rail section 44 to be manipulated into and out of the machine 10 vertically between an adjacent pair of upper transverse members 16. Each tooling rail 44 is provided with mounting through-holes 48 spaced on eight inch centers to match the spacing of the mounting holes 42. To secure the tooling rail 44 to the mounting rail 36, threaded members, such as screws or bolts, 50 extend through the holes 48 and into the holes 42. The holes 48 are along a line parallel to the longitudinal axis of the tooling rail 44, which line is uniquely located for each lateral profile so that the required offset is built into the tooling rail itself. Thus, as shown in FIGS. 2 and 3, there are illustratively two mounting rails 36 on the right side of the machine 10. Depending on the lateral profile being formed by the tooling installed in the machine 10, each of the mounting rails 36 is secured in a particular set of mounting holes 34. The combination of the particular set of mounting holes 34 and the location of the line for the holes 48 in the tooling rails 44 determines the offset between the roll forming elements 46 on the two mounting rails 36. Therefore, no final adjustments are required on the right side of the machine 10 when changing from one lateral profile to another.

The mounting of the tooling on the left side of the machine 10 is arranged differently from the mounting on the right side. In particular, mounting rails 52, of the same general construction as the mounting rails 36, are permanently bolted to traveler bar blocks 54 which are in turn secured to threaded traveler nuts 56 mounted on threaded adjustment shafts 58. Tooling rails 60, of the same general construction as the tooling rails 44 and having roll forming elements 62 defining roll forming stations secured thereto, are secured to the mounting rails 52. The mounting rails 52 and the tooling rails 60 have the same mounting hole configurations for their connection as do the mounting rails 36 and the tooling rails 44, respectively, except that there is only a single line for the mounting holes on the tooling rails 60. Thus, a tooling rail section 60, like a tooling rail section 44, can be manipulated into and out of the machine 10 vertically between an adjacent pair of upper transverse members 16.

The threaded adjustment shafts 58 extend into the rigid cage interior of the machine 10 from the side frame 14 orthogonally to the side frames 12,14. The inner ends of the shafts 58 are journalled for rotation in the bearing blocks 64. The outer ends of the shafts 58 extend through the bearing blocks 66 and are terminated by bevel gears 68. Rotation of the threaded shafts 58 moves the traveler nuts 56, along with the mounting rails 52 and their respective tooling rails 60, toward and away from the side frame 12, depending upon the direction of rotation of the shafts 58. This provides a way to vary the distance between the roll forming stations on the left and right sides of the machine 10. Rotation of the shafts 58 is effected by turning the crank handle 70 which is connected through gearing (not shown) to the first adjustment shaft 58 and to the transfer shaft 72. The transfer shaft 72 extends orthogonally to the adjustment shafts 58 and is connected to their bevel gears 68 through the bevel gears 74 spaced along its length.

Figure 6:
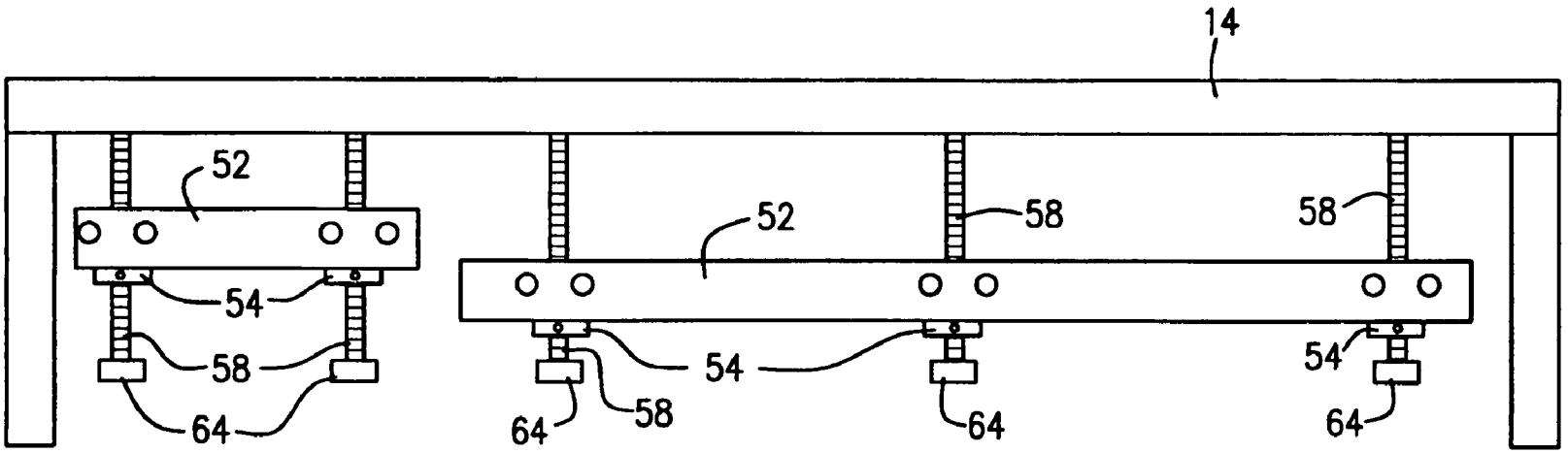
FIG. 6 is a schematic top plan view of the inventive machine showing the left side mounting rail structures.
Figure 7:
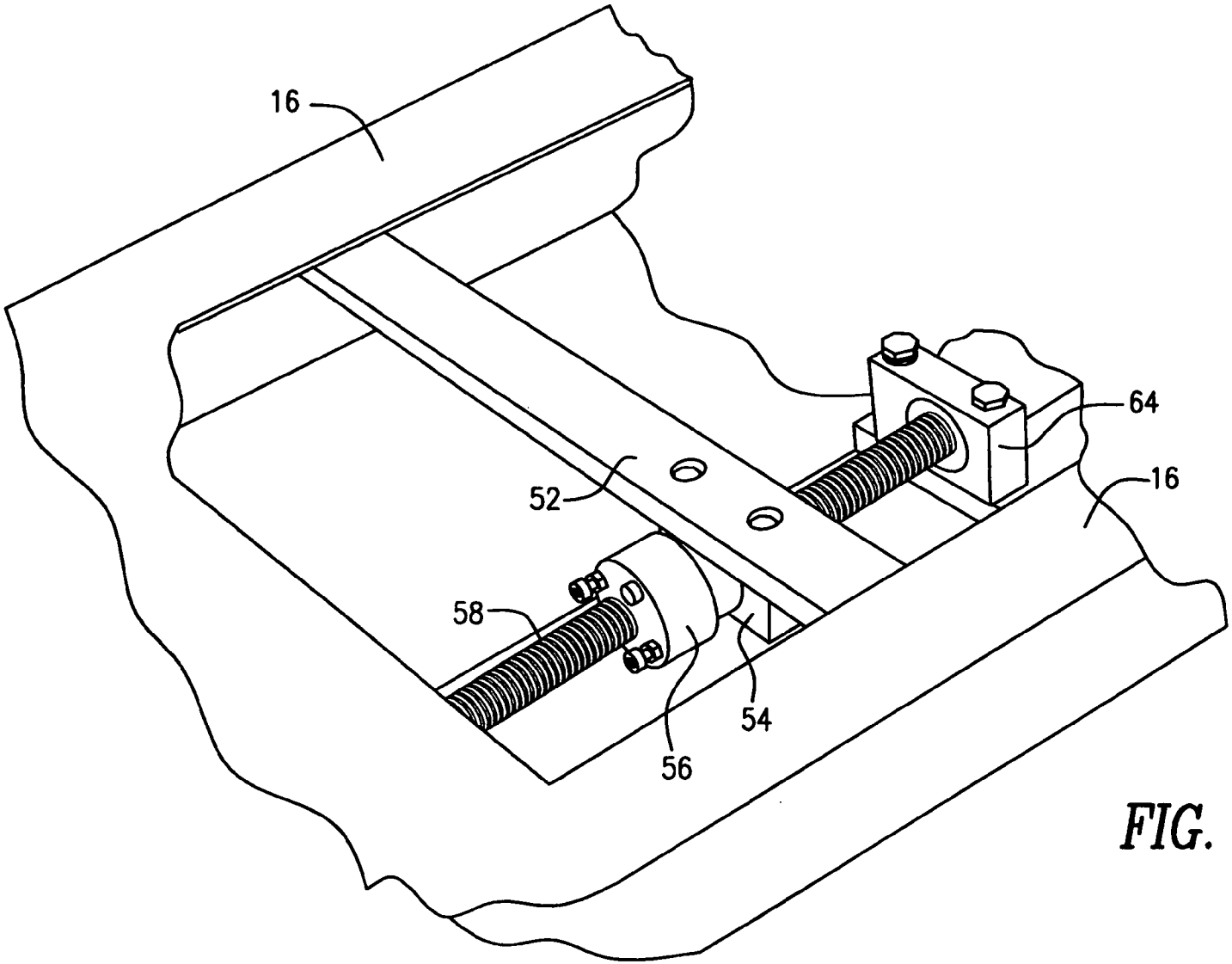
FIG. 7 is a perspective view of a traveler bar block.
Figure 8:
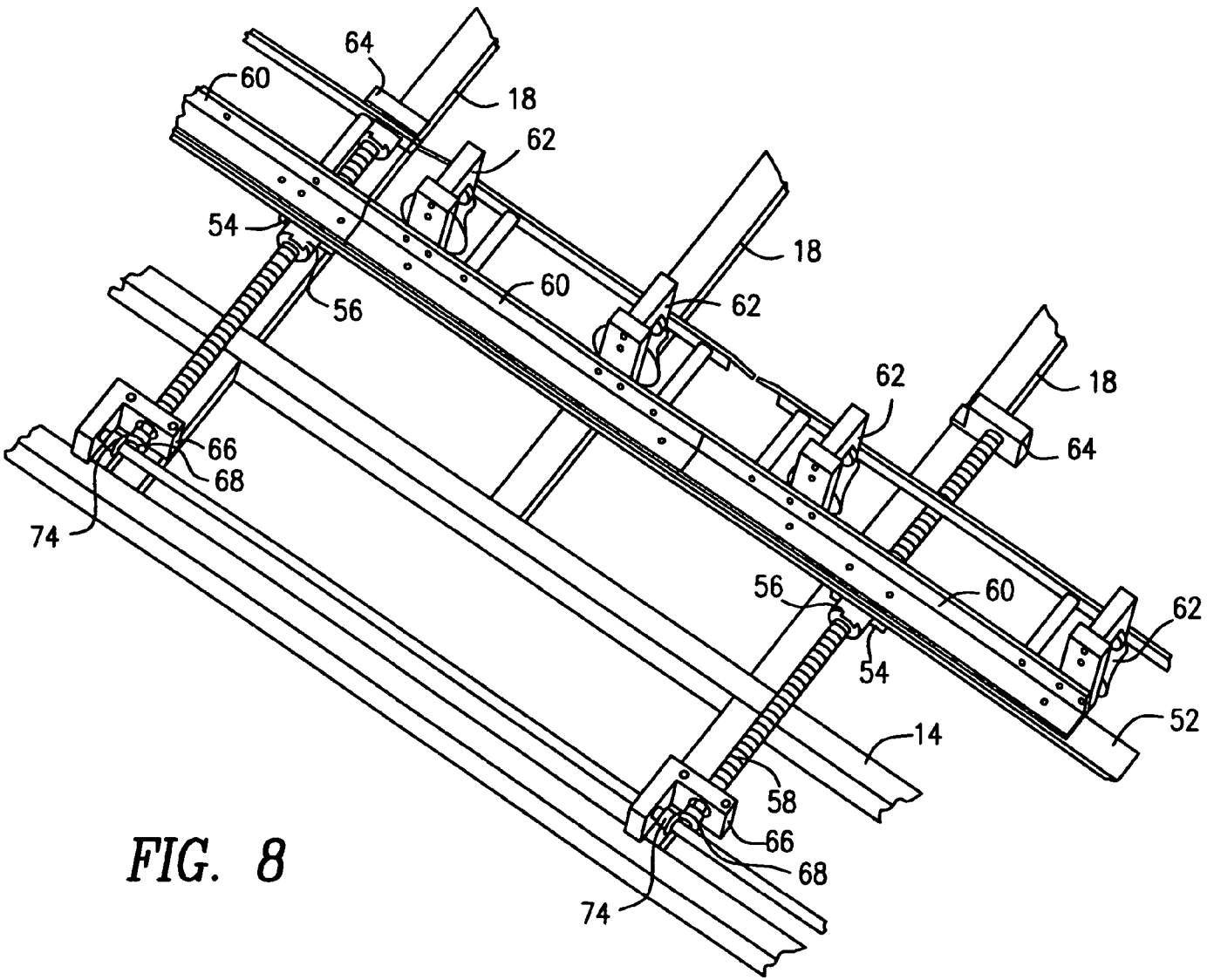
FIG. 8 is a perspective view of the inventive adjustment mechanism for the traveler bar blocks on the left side of the inventive machine.

As shown in FIGS. 2 and 6, there are illustratively two mounting rails 52 on the left side of the machine 10. Each different lateral profile formed by a different set of tooling requires a different offset between the two left side mounting rails, as well as a different spacing between the roll forming stations on the left and right sides of the machine 10. The operator's manual provided with the machine 10 includes a chart setting forth this offset and spacing. To accommodate the offset between the two mounting rails 52, the transfer shaft 72 is formed as two sections with a clutch 76 interposed between the two sections so as to separate the two mounting rails 52. The clutch 76 has two parts, a fixed half 78 and a sliding half 80.

Figure 9A:
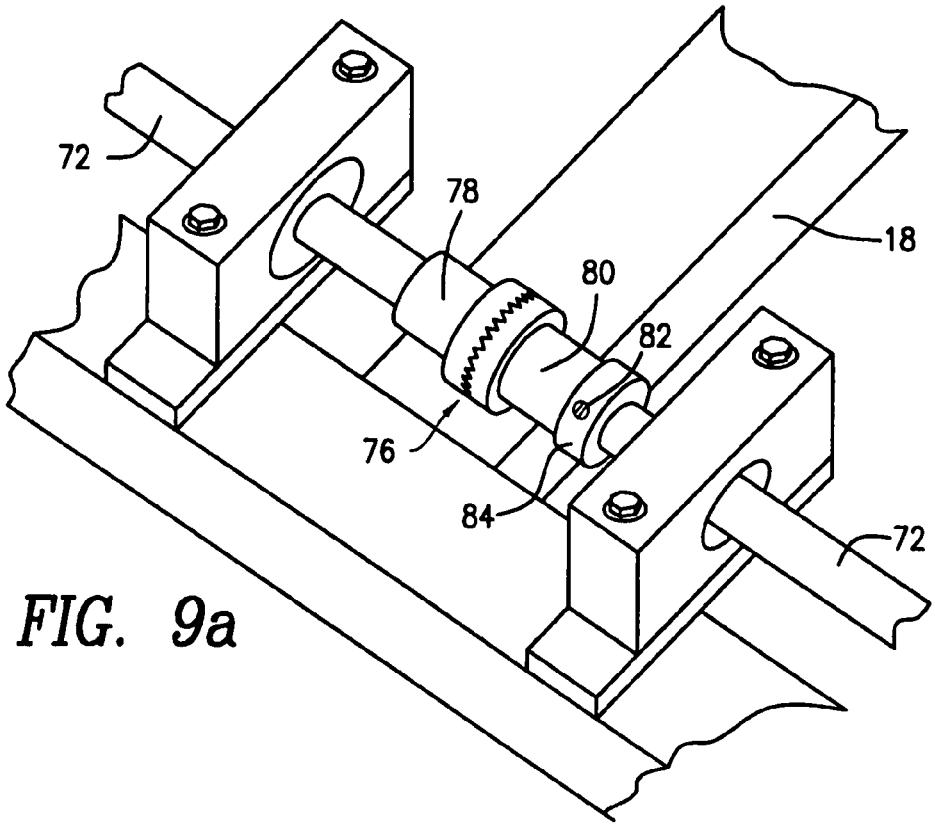
FIGS. 9*a* and 9*b* are perspective views of the clutch in the adjustment mechanism shown in FIG. 8, with the clutch engaged and disengaged, respectively.
Figure 9B:
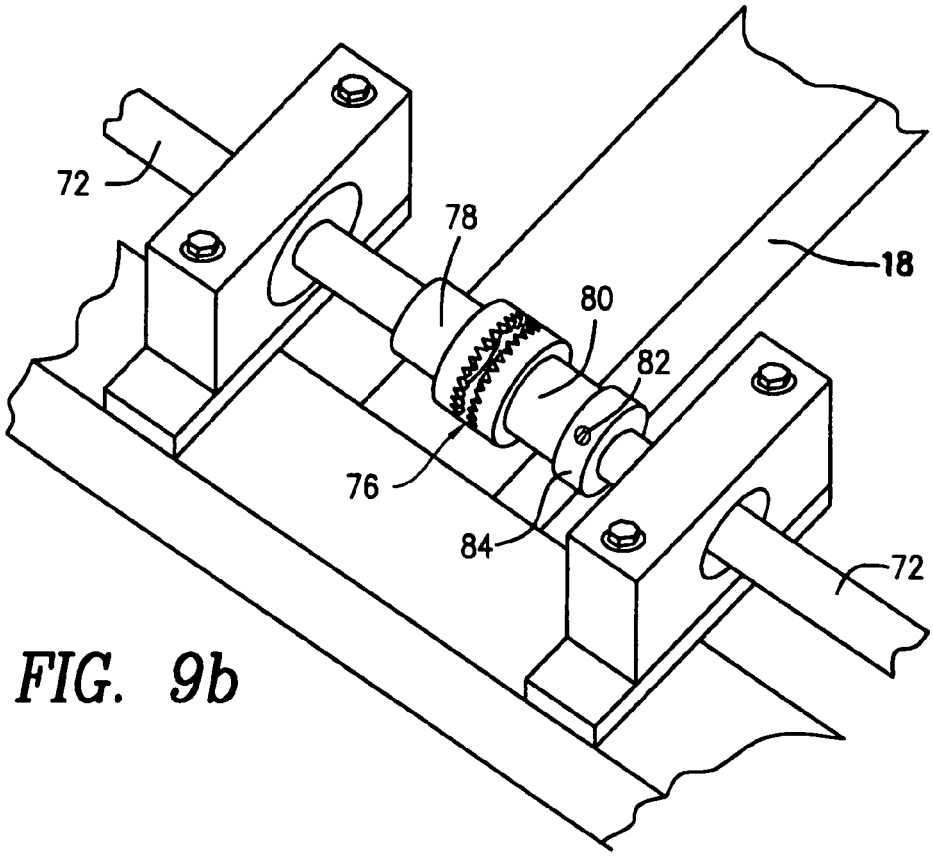

Thus, when a new set of tooling is to be installed in the machine 10, the set screw 82 on the collar 84 is loosened and the sliding half 80 of the clutch 76 is slid to the right, as viewed in FIGS. 9*a* and 9*b*, to separate the clutch teeth and disengage the two halves of the clutch 76. With the clutch 76 disengaged, the crank handle 70 is turned to obtain the appropriate offset between the two mounting rails 52. By adjusting the offset in this manner, it will be appreciated that the process of adjusting the offset is greatly simplified. The clutch 76 is then engaged by moving the sliding half 80 to the left and tightening the set screw 82. The crank handle 70 is then turned to set the appropriate distance between the left and right side roll forming stations, in accordance with the desired lateral profile to be formed by the new set of tooling.

Accordingly, there has been disclosed an improved roll forming machine wherein a single operator can quickly replace roll forming stations to change the desired lateral profile and wherein adjustments to the lateral positions of the roll forming stations can be quickly effected. While a preferred embodiment of the present invention has been disclosed herein, it will be appreciated by those of skill in the art that various modifications and adaptations to the disclosed embodiment are possible. It is therefore intended that this invention be limited only by the scope of the appended claims.

What is claimed is:

1. A roll forming machine of the type which forms an indeterminate length panel of a desired lateral profile from a uniform width supply strip of sheet metal having a pair of parallel straight edges, said roll forming machine driving said supply strip along a predetermined path of travel through a plurality of roll forming stations and comprising:

a rigid framework including a pair of rigid parallel side frames interconnected one to the other by a plurality of rigid parallel upper and lower transverse members to form a rigid cage having an interior and a width between said side frames;

a plurality of mounting blocks each supported on a respective one of said lower transverse members adjacent a first one of said pair of side frames, each of said mounting blocks having an upper horizontal surface and a plurality of spaced mounting holes extending into said each mounting block from said upper surface, said plurality of mounting holes for each of said mounting blocks extending along a respective line orthogonal to said pair of side frames and having identical spacing on all of said plurality of mounting blocks, and wherein the upper horizontal surfaces of all of said plurality of mounting blocks lie along a single horizontal plane;

a first mounting rail secured to at least two of said plurality of mounting blocks by at least two mounting threaded members each extending through a respective opening in said first mounting rail and into a respective mounting hole in a respective one of said at least two mounting blocks, wherein each of said respective mounting holes occupies the same relative position in its respective mounting block;

a first tooling rail;

at least one fastener detachably securing said first tooling rail to said first mounting rail; and at least one set of roll forming elements each defining a roll forming station secured to said first tooling rail;

wherein said first tooling rail with said at least one set of roll forming elements secured thereto is dimensioned so that it can be manipulated into and out of said cage vertically between an adjacent pair of upper transverse members without removing said first mounting rail from said cage.

2. The roll forming machine according to claim 1 wherein:

said first mounting rail is formed with a plurality of equally spaced mounting holes along a line adapted to be parallel to said side frames when said first mounting rail is secured to said mounting blocks;

said first tooling rail is formed with a plurality of openings along a line, wherein said plurality of openings are registrable in pairs with respective pairs of the mounting holes of said first mounting rail; and said at least one fastener includes a plurality of threaded members each extendable through a respective first tooling rail opening and into a respective first mounting rail mounting hole for securing said first tooling rail to said first mounting rail.

3. The roll forming machine according to claim 1 wherein each of said mounting blocks is adjustably positionable relative to said respective lower transverse member along a line orthogonal to said pair of side frames.

4. The roll forming machine according to claim 1 further comprising:

a first plurality of threaded shafts extending into said cage from a second one of said pair of side frames and orthogonal to said pair of side frames;

a first plurality of traveler bar blocks each threadedly secured to a respective one of said first plurality of threaded shafts for movement therealong;

a second mounting rail secured to at least two of said first plurality of traveler bar blocks;

a second tooling rail separate from, and detachably secured to, said second mounting rail; and at least one set of roll forming elements each defining a roll forming station secured to said second tooling rail;

wherein said second tooling rail with said at least one set of roll forming elements secured thereto is dimensioned so that it can be manipulated into and out of said cage vertically between an adjacent pair of upper transverse members without removing said second mounting rail from said cage.

5. The roll forming machine according to claim 4 further comprising adjustment means outside said cage and coupled to said first plurality of threaded shafts for controllably rotating said first plurality of threaded shafts to selectively move said first plurality of traveler bar blocks toward and away from said second one of said pair of side frames.

6. The roll forming machine according to claim 5 further comprising:

a second plurality of threaded shafts extending into said cage from said second one of said pair of side frames and orthogonal to said pair of side frames;

a second plurality of traveler bar blocks each threadedly secured to a respective one of said second plurality of threaded shafts for movement therealong;

a third mounting rail secured to at least two of said second plurality of traveler bar blocks;

a third tooling rail secured to said third mounting rail; and at least one set of roll forming elements each defining a roll forming station secured to said third tooling rail;

wherein said third tooling rail with said at least one set of roll forming elements secured thereto is dimensioned so that it can be manipulated into and out of said cage vertically between an adjacent pair of upper transverse members; and wherein said adjustment means is also coupled to said second plurality of threaded shafts and includes a clutch coupled between said first and second pluralities of threaded shafts, said clutch being selectively engagable and disengagable to couple and uncouple, respectively, said first and second pluralities of traveler bar blocks for concurrent movement.

7. A roll forming machine of the type which forms an indeterminate length panel of a desired lateral profile from a uniform width supply strip of sheet metal having a pair of parallel straight edges, said roll forming machine driving said supply strip along a predetermined path of travel through a plurality of roll forming stations and comprising:

a rigid framework including a pair of rigid parallel side frames interconnected one to the other by a plurality of rigid parallel upper and lower transverse members to form a rigid cage having an interior and a width between said side frames;

a first plurality of threaded shafts extending into said cage from a first one of said pair of side frames and orthogonal to said pair of side frames;

a first plurality of traveler bar blocks each threadedly secured to a respective one of said first plurality of threaded shafts for movement therealong;

a first mounting rail secured to at least two of said first plurality of traveler bar blocks;

a first tooling rail;

at least one fastener detachably securing said first tooling rail to said first mounting rail; and at least one set of roll forming elements each defining a roll forming station secured to said first tooling rail;

wherein said first tooling rail with said at least one set of roll forming elements secured thereto is dimensioned so that it can be manipulated into and out of said cage vertically between an adjacent pair of upper transverse members without removing said first mounting rail from said cage.

8. The roll forming machine according to claim 7 further comprising adjustment means outside said cage and coupled to said first plurality of threaded shafts for controllably rotating said first plurality of threaded shafts to selectively move said first plurality of traveler bar blocks toward and away from said first one of said pair of side frames.

9. The roll forming machine according to claim 8 further comprising:

a second plurality of threaded shafts extending into said cage from said first one of said pair of side frames and orthogonal to said pair of side frames;

a second plurality of traveler bar blocks each threadedly secured to a respective one of said second plurality of threaded shafts for movement therealong;

a second mounting rail secured to at least two of said second plurality of traveler bar blocks;

a second tooling rail separate from, and detachably secured to, said second mounting rail; and at least one set of roll forming elements each defining a roll forming station secured to said second tooling rail;

wherein said second tooling rail with said at least one set of roll forming elements secured thereto is dimensioned so that it can be manipulated into and out of said cage vertically between an adjacent pair of upper transverse members without removing said second mounting rail from said cage; and wherein said adjustment means is also coupled to said second plurality of threaded shafts and includes a clutch coupled between said first and second pluralities of threaded shafts, said clutch being selectively engagable and disengagable to couple and uncouple, respectively, said first and second pluralities of traveler bar blocks for concurrent movement.

10. The roll forming machine according to claim 7 further comprising:

a plurality of mounting blocks each supported on a respective one of said lower transverse members adjacent a second one of said pair of side frames, each of said mounting blocks having an upper horizontal surface and a plurality of spaced mounting holes extending into said each mounting block from said upper surface, said plurality of mounting holes for each of said mounting blocks extending along a respective line orthogonal to said pair of side frames and having identical spacing on all of said plurality of mounting blocks, and wherein the upper horizontal surfaces of all of said plurality of mounting blocks lie along a single horizontal plane;

a third mounting rail secured to at least two of said plurality of mounting blocks by at least two mounting threaded members each extending through a respective opening in said third mounting rail and into a respective mounting hole in a respective one of said at least two mounting blocks, wherein each of said respective mounting holes occupies the same relative position in its respective mounting block;

a third tooling rail separate from, and detachably secured to, said third mounting rail; and at least one set of roll forming elements each defining a roll forming station secured to said third tooling rail;

wherein said third tooling rail with said at least one set of roll forming elements secured thereto is dimensioned so that it can be manipulated into and out of said cage vertically between an adjacent pair of upper transverse members without removing said third mounting rail from said cage.

11. The roll forming machine according to claim 10 wherein:

said third mounting rail is formed with a plurality of equally spaced mounting holes along a line adapted to be parallel to said side frames when said third mounting rail is secured to said mounting blocks; and said third tooling rail is formed with a plurality of openings along a line, wherein said plurality of openings are registrable in pairs with respective pairs of the mounting holes of said third mounting rail;

said roll forming machine further including a plurality of bolts each extendable through a respective third tooling rail opening and into a respective third mounting rail mounting hole for securing said third tooling rail to said third mounting rail.

12. The roll forming machine according to claim 10 wherein each of said mounting blocks is adjustably positionable relative to said respective lower transverse member along a line orthogonal to said pair of side frames.

* * * * *